US008821435B2

(12) United States Patent
Hazan

(10) Patent No.: US 8,821,435 B2
(45) Date of Patent: Sep. 2, 2014

(54) DEVICE FOR ADMINISTERING MEDICINE

(76) Inventor: Haim Hazan, Yerucham (IL)

( * ) Notice: Subject to any disclaimer, the term of this patent is extended or adjusted under 35 U.S.C. 154(b) by 381 days.

(21) Appl. No.: 13/062,179

(22) PCT Filed: Sep. 6, 2009

(86) PCT No.: PCT/IL2009/000860

§ 371 (c)(1),
(2), (4) Date: Aug. 11, 2011

(87) PCT Pub. No.: WO2010/026586

PCT Pub. Date: Mar. 11, 2010

(65) Prior Publication Data

US 2011/0295197 A1 Dec. 1, 2011

(30) Foreign Application Priority Data

Sep. 7, 2008 (IL) ..... 193929
Sep. 1, 2009 (IL) ..... 200682

(51) Int. Cl.
*A61J 7/00* (2006.01)

(52) U.S. Cl.
CPC ..... *A61J 7/0053* (2013.01); *A61J 7/0061* (2013.01)
USPC ..... 604/77

(58) Field of Classification Search
CPC ..... A61J 7/0053; A61J 7/0061
USPC ..... 604/77, 181, 187
See application file for complete search history.

(56) References Cited

U.S. PATENT DOCUMENTS

| | | | | |
|---|---|---|---|---|
| 3,780,735 A | | 12/1973 | Crouter et al. | 128/223 |
| 5,244,122 A | | 9/1993 | Botts | 222/133 |
| 5,318,523 A | | 6/1994 | Lu | 604/77 |
| 5,431,680 A | * | 7/1995 | Jones | 606/236 |
| 5,843,030 A | | 12/1998 | Van Der Merwe | 604/77 |
| 5,891,165 A | | 4/1999 | Buckner | 606/234 |
| 6,007,335 A | * | 12/1999 | Sheu | 433/90 |
| 6,511,455 B1 | | 1/2003 | Tuoriniemi | 604/77 |
| 6,583,048 B1 | | 6/2003 | Vincent et al. | 438/623 |
| 6,981,962 B1 | | 1/2006 | Lenkersdorf | 604/78 |
| 2004/0111053 A1 | * | 6/2004 | Nicolette | 604/59 |

FOREIGN PATENT DOCUMENTS

| | | |
|---|---|---|
| AT | 409 717 | 10/2002 |
| WO | 92/00717 | 1/1992 |

* cited by examiner

*Primary Examiner* — Nicholas Lucchesi
*Assistant Examiner* — Leah Stohr
(74) *Attorney, Agent, or Firm* — Seed IP Law Group PLLC

(57) ABSTRACT

The invention provides a medicine dispenser device for liquids intended to be swallowed, particularly by children and patients who find it difficult to cooperate, the device comprising an elongated cylinder serving as a container for the liquid, the device being provided, in accordance with the requirements of its use and the type of liquid to be dispensed, with at least one dispensing exit outlet at the distal end of the cylinder, the cylinder having a longitudinal axis and the at least one dispensing outlet being positioned to direct at least one stream of dispensed liquid at an angle of between 20° and 170° relative to the distal end of the longitudinal axis of the container, the safety arrangement of the device being such that upon introduction of the distal end of the device into the mouth of a patient, the at least one stream of dispensed liquid is directed to exit towards at least one enveloping surface of the mouth cavity and not in a direction toward the patient's windpipe and the throat opening.

9 Claims, 6 Drawing Sheets

DEVICE FOR ADMINISTERING MEDICINE

The present invention relates to a medicine dispenser device for liquids and especially to improvements in syringe-like medicine dispensers.

More particularly, the invention provides a syringe-like device for the purpose of introducing liquid medicines to be swallowed, into the mouth in a safer and more comfortable manner than has been possible with conventional devices.

For brevity, male terms are used in the present document to refer to the patient. These terms are however to be interpreted as also referring to female patients.

BRIEF DESCRIPTION OF THE PRIOR ART

Syringes for administering liquid medicines intended to be swallowed are known all over the world, and most of the drug companies include such a syringe in the packaging of the liquid medicines that they market. Syringes for taking liquid medicines to be swallowed are known in the literature, and variations of such devices can be seen, for example, in U.S. Pat. Nos. 5,244,122; 5,843,030; 5,891,165; 6,007,335; 6,511,455 and 6,981,962, which in combination provide a reasonable survey of the prior art.

A serious problem exists in all of the designs mentioned. Since the liquid within, exits in a straight direction from the exit openings of these devices, it is natural that the liquid stream comes out first in the crowded area of the mouth, at a distance between the center of the mouth and the inner throat and the chances are that it will continue toward the windpipe and the sensitive inner opening of the patient's throat, such that it is likely to cause discomfort to the patient, accompanied by a choking sensation, stimulation of the retching reflex, and spitting out of the medicine. It would be more difficult to get anyone who has had this unpleasant experience to cooperate in the future, especially children and people with limitations.

Surprisingly, no relevant patent documents were found in a search which related to the dangers of directing a liquid medicine directly at the throat of a patient. Therefore, one of the purposes of the present invention is to obviate the disadvantages of the prior art syringes and to provide a safe device for administering liquid medicines, particularly to children and people with limitations.

The device of the present invention is safe and comfortable, and shortens the unpleasant sensation involved in administering liquid medicines to be swallowed, thus providing better utilization of the treatment required for the patient's recovery.

The device is built to direct the liquids to exit at the desired depth inside the mouth, at the sides of the mouth and tongue and far from the windpipe and the sensitive inner opening of the throat. These are problematic areas; close access to them or spraying a medicine in their direction should be prevented as much as possible, since it may cause discomfort to the patient, a choking sensation and evoke strong reaction, a scenario which many parents and patients have experienced or seen.

It is the object of the present invention to eliminate these disadvantages.

The present invention achieves the above objects by providing a medicine dispenser device for liquid medicines intended to be swallowed, particularly for young children and patients who find it difficult to cooperate, the device comprising an elongated cylinder serving as a container for said liquid, said device being provided, in accordance with the requirements of its use and the type of liquid to be dispensed, with at least one dispensing exit outlet at the distal end of said cylinder, said cylinder having a longitudinal axis and said at least one dispensing outlet being positioned to direct at least one stream of dispensed liquid at an angle of between 20° and 170° relative to the distal end of the longitudinal axis of said container, the safety arrangement of the device being such that upon introduction of the distal end of said device into the mouth of a patient, the at least one stream of dispensed liquid is directed to exit towards at least one enveloping surface of the mouth cavity and not in a direction toward, the patient's windpipe and throat opening.

Preferably said at least one enveloping surface is selected from the group consisting of an area of the inner cheek, the tongue and combinations thereof.

In preferred embodiments of the present invention, said liquid medicine dispenser device further comprises a piston-like member sized for close frictional engagement with the inner surface of said cylinder for drawing liquids into the cylindrical container and afterwards expelling the liquids from said container through said at least one outlet.

In some preferred embodiments of the present invention said elongated cylinder is further provided with at least one air entry hole provided in a side surface of said cylinder adjacent the proximal end thereof above the position of said piston-like member when said container is filled with the maximum recommended dosage of liquid to be dispensed from said container.

In some preferred embodiments of the present invention, said medicine dispenser device comprises one dispensing exit outlet for administering liquid, wherein said cylinder has a longitudinal axis and said dispensing exit outlet is located in a manner directing the stream of dispensed liquid at an angle of between 20° and 170° relative to the longitudinal axis of said container.

In other preferred embodiments of the present invention said medicine dispenser device comprises at least two spaced-apart exit outlets for dispensing liquids, located at the distal end of said cylinder, said device being designed to be inserted into the patient's mouth and to enable directing the streams of the dispensed liquid towards at least two enveloping surfaces of the patient's mouth cavity, each of said streams being dispensed at an angle of between 20° and 170° relative to the longitudinal axis of said container.

In especially preferred embodiments of the present invention said medicine dispenser device further provides an adjustable slidable disk mounted on said elongated cylindrical container, sized and positionable to engage the patient's lips upon insertion of the device into the mouth of the patient and to delineate the extent of insertion of the distal end of said device into the patient's mouth.

This embodiment allows, first of all, measured control of the desired and safest depth of entry of the cylindrical container for spraying the medicine into the patient's mouth and preventing possible physical damage caused by the distal end of the cylinder to the sensitive areas deep inside the mouth, mainly when there is movement and objection on the part of the patient, or when the hands of the administrator are not stable.

Said disk will additionally make it easier to diminish the threatening appearance of the medicine dispenser device, from which children, mainly, recoil, and also to limit cases in which the patient is likely to spray the liquid from his mouth in all directions.

A variation of the above embodiment is one in which the mounted disk is stationary and the medicine dispenser device is manufactured for use with different aged patients with different sized oral cavities.

Thus, in other preferred embodiments of the present invention said medicine dispenser device comprises a disk mounted on said elongated cylindrical container, at a distance of between 5-55 mm from the distal end of said container, and sized and positionable to engage the patient's lips upon insertion of the device into the mouth of the patient and to delineate the extent of insertion of the distal end of said device into the patient's mouth.

In especially preferred embodiments of the present invention said cylinder is provided with opposed gripping flanges positioned at a distance of at least 5 mm from the proximal end of said cylinder.

Preferably, said cylinder is provided with opposed gripping flanges positioned at a distance of between 5 mm and 50 mm from the proximal end of said cylinder.

In another aspect of the present invention, there is provided a medicine dispenser device for liquids intended to be swallowed, particularly for children and patients who find it difficult to cooperate, the device comprising an elongated cylinder serving as a container for said liquid medicine, said device being provided, in accordance with the requirements of its use and the type of liquid to be dispensed, with at least one dispensing exit outlet at the distal end of said cylinder and said device further comprising an adjustable slidable disk mounted on said elongated cylindrical container, sized and positionable to engage the patient's lips upon insertion of the device into the mouth of the patient and to delineate the extent of insertion of the distal end of said device into the patient's mouth.

In yet another aspect of the present invention there is provided a medicine dispenser device for liquids intended to be swallowed, particularly for children and patients who find it difficult to cooperate, the device comprising an elongated cylinder serving as a container for said liquid medicine, said device being provided, in accordance with the requirements of its use and the type of liquid to be dispensed, with at least one dispensing exit outlet at the distal end of said cylinder and said device further comprising a disk mounted on said elongated cylindrical container, at a distance of between 5-55 mm from the distal end of said container, and sized and positionable to engage the patient's lips upon insertion of the device into the mouth of the patient and to delineate the extent of insertion of the distal end of said device into the patient's mouth.

Said disk will additionally make it easier to diminish the threatening appearance of the medicine dispenser device, from which children, mainly, recoil, and also to limit cases in which the patient is likely to spray the liquid from his mouth in all directions and dirty a wide surrounding area.

The disk allows, in accordance with the patient, measured control of the depth of entry desired and which is safest for spraying the medicine into the patient's mouth and preventing possible physical damage caused by the end of the cylinder to the sensitive areas deep inside the mouth, mainly when there is objection on the part of the patient, or when the hands of the administrator are unsteady. The disk will additionally make it easier to diminish the threatening appearance of the medicine dispenser device, from which children, mainly, recoil, and also to prevent many cases in which the patient is likely to spray the liquid from his mouth causing loss of the medicine and dirtying the bed sheets, the floor and/or other items in the vicinity.

The efficiency and added safety provided by the disk cause it to become an important part appropriate for use on any cylindrical device for dispensing liquid medicine.

In a further aspect of the present invention, there is provided a medicine syringe device for liquids comprising an elongated cylinder serving as a container for said liquid, said device being provided, in accordance with the requirements of its use and the type of liquid to be dispensed, with at least one dispensing exit outlet at the distal end of said cylinder wherein said cylinder is provided with opposed gripping flanges positioned at a distance of at least 5 mm from the proximal end of said cylinder.

Preferably said cylinder is provided with opposed gripping flanges positioned at a distance of between 5 mm and 50 mm from the proximal end of said cylinder.

In yet another aspect of the present invention, there is provided a medicine dispenser device for liquids intended to be swallowed, particularly for children and patients who find it difficult to cooperate, the device comprising an elongated cylinder serving as a container for said liquid medicine, said device being provided, in accordance with the requirements of its use and the type of liquid to be dispensed, with at least one dispensing exit outlet at the distal end of said cylinder further comprising a piston-like member sized for close frictional engagement with the inner surface of said cylinder for drawing liquids into the cylindrical container and afterwards expelling the liquids from said container through said at least one outlet and wherein said elongated cylinder is further provided with at least one air entry hole provided in a side surface of said cylinder adjacent the proximal end thereof above the position of said piston-like member when said container is filled with the maximum recommended dosage of liquid to be dispensed from said container.

In a further preferred embodiment, there is described a cylindrical device for dispensing medicine equipped with a plunger and further including opening(s) for the entry of air in the upper side of the container and above the dosage scale generally indicated on the spray container. The indicated opening is located at the upper portion of the cylinder in an area where said opening has no connection or influence upon the ordinary operations of suction and compression by the plunger or upon the exactness of the recommended dosage drawn. This opening is of importance when the caretaker prefers that the medicine will be administered from the container by means of the patient sucking the device, instead of being sprayed into the patient's mouth by pressing the plunger.

The indicated purpose is achieved after the required dose is drawn into the container by an additional gentle pulling of the plunger upward to the stopping point where the plunger is stopped close to the upper lip of the container.

The resultant exposure of the opening(s) to the entry of air, allows the patient, particularly children, to suck the medicine at his own speed.

Another preferred embodiment of the present invention describes a device including an elongated cylindrical container intended for a liquid medicine in which the holding and pressing area opposite the plunger is lowered at its upper end in order to further shorten the distance between the fingers holding the container and its far end. Thus, the administrator will have a firm and steady grip on the container at the time of its use.

It will thus be understood that the novel container of the present invention includes new safety and comfort features that do not appear in the prior art devices. The device of the present invention is appropriate for all patients who need to receive liquid medicine or other liquids to be swallowed, especially for infants and children, who may not cooperate fully.

The proposed solution will provide patients with more security and comfort, mainly for children, who will express a greater willingness on their part to cooperate, and thus the parents and caretakers will also benefit.

The device can conveniently be used in several ways, in accordance with the age and type of the patient.

DESCRIPTION OF IMPLEMENTATION OF THE INVENTION

The manufacturing of plungers and complementary cylinders is a recognized and relatively simple technology, similar to the art used to manufacture existing syringes. The relatively small size of the components makes the process more efficient and less expensive. These components can be manufactured in injection molds with an appropriate arrangement ("wagons" in Hebrew) in accordance with the number of exit openings desired, this according to the existing knowledge in industry that has been created over decades from a vast variety of different products having different variations of openings.

In the present injection device, as in any other, the action of drawing the liquid into the cylindrical container should be done according to the required dose, and the liquid should be compressed in order for it to exit through the exit openings. This is carried out by means of a part similar to a piston (plunger), the size of which is coordinated to be in frictional contact with the inner surface of said cylinder. The manufacture of a plunger as stated above has been known for decades, and the option exists of making use of the molds and products already existing in the market with the aim of easing the stage of transition to manufacturing.

An additional possibility for applying pressure to the liquid medicine is to use a pressure bubble.

Another possibility, as in every syringe, is to apply pressure to the liquid so that it will exit through the exit openings. This pressure can be applied by means of attaching the upper opening of the cylinder to a source of compressed air, which is generally available in hospitals, but it is essential to control it very carefully so as to ensure a precise dosage at determined times.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

IN THE DRAWINGS

Figure 1:
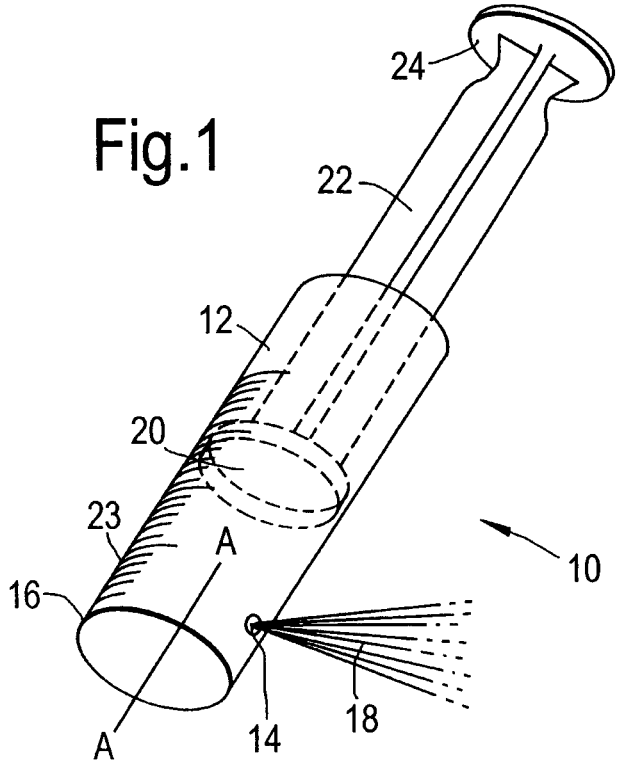
FIG. 1 is a perspective view of a preferred embodiment of the device according to the invention.

There is seen in FIG. 1 a medicine dispenser device 10 for liquids intended to be swallowed by patients, that are particularly useful for children and patients who find it difficult to cooperate.

The device comprises an elongated cylinder 12 serving as a container for the liquid medicine. The device 10 is provided, in accordance with the requirements of its use and the type of liquid to be dispensed, with at least one dispensing outlet 14 at the distal end 16 of the cylinder 12, The cylinder 12 has a longitudinal axis AA and the dispensing outlet 14 is positioned to direct at least one stream 18 of dispensed liquid at an angle of between 20° and 170° relative to the distal end 16 of the longitudinal axis AA of the container.

As will be seen in FIG. 1, the safety arrangement of the device 10 is such that upon introduction of the distal end 16 of the device into the mouth of a patient, the stream 18 of dispensed liquid is directed to exit towards at least one enveloping surface, e.g., the palette, the cheek area and/or the tongue of the mouth cavity, and not in a direction towards the patient's windpipe and the throat opening.

In the preferred embodiment of the device 10 a piston-like flexible member or plunger 20 is sized for close frictional sliding engagement with the inner surface of the cylinder 12 for drawing liquids into the cylindrical container 12.

Thereafter opposite direction movement of the plunger 20 expels the liquid from the container through the outlet 14. A stem 22 and end plate 24 allow manipulation of the flexible member 20.

Scale markings 23 are seen marked on the cylinder 12.

With regard to the rest of the figures, similar reference numerals have been used to identify similar parts.

Figure 2:
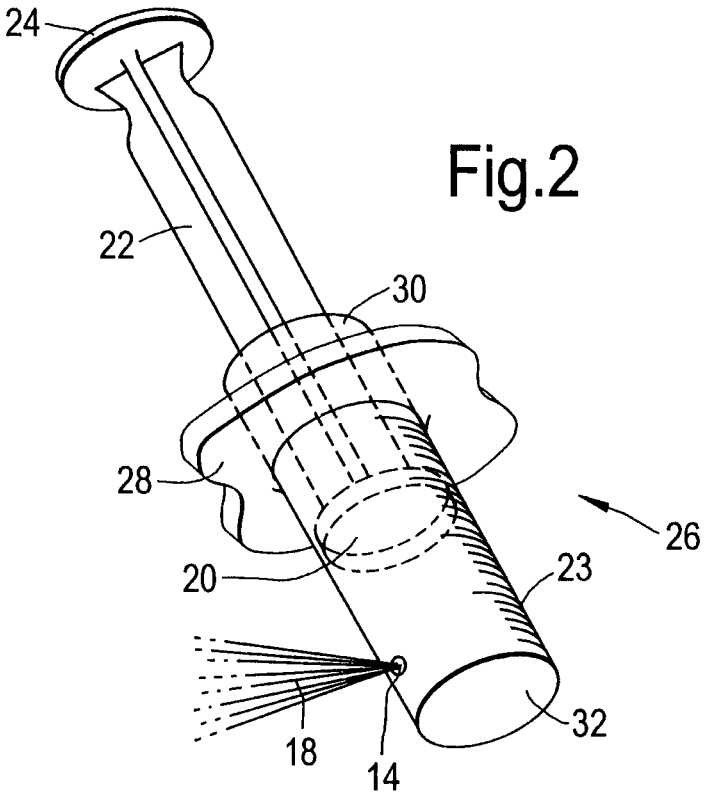
FIG. 2 is a perspective view of an embodiment carrying a spacing disk to control depth of entry.

Referring now to FIG. 2, there is seen a further medicine dispenser device 26 similar to the device 10 seen in FIG. 1. The disk 28 is mounted on the elongated cylindrical container 30, and is sized to engage the patient's lips upon insertion of the distal end 32 of the device 26 into the mouth of the patient and to delineate the extent of insertion of the distal end 32 into the patient's mouth. The disk 28 can be positioned for normal adult use in a first embodiment, e.g., for an adult who is not conscious and in a second embodiment the disk 28 can be disposed nearer the distal end 32 to be suitable for children. Furthermore, the disk can simply be removed when not needed.

In this embodiment, said disk is fixedly mounted on said elongated cylindrical container at a distance of between 5 and 55 mm from the distal end of said container and sized and positionable to engage the patient's lips upon insertion of the distal end of said device into the mouth of the patient and to delineate the extent the extent of insertion of said distal end of said device into the patient's mouth.

Figure 3:
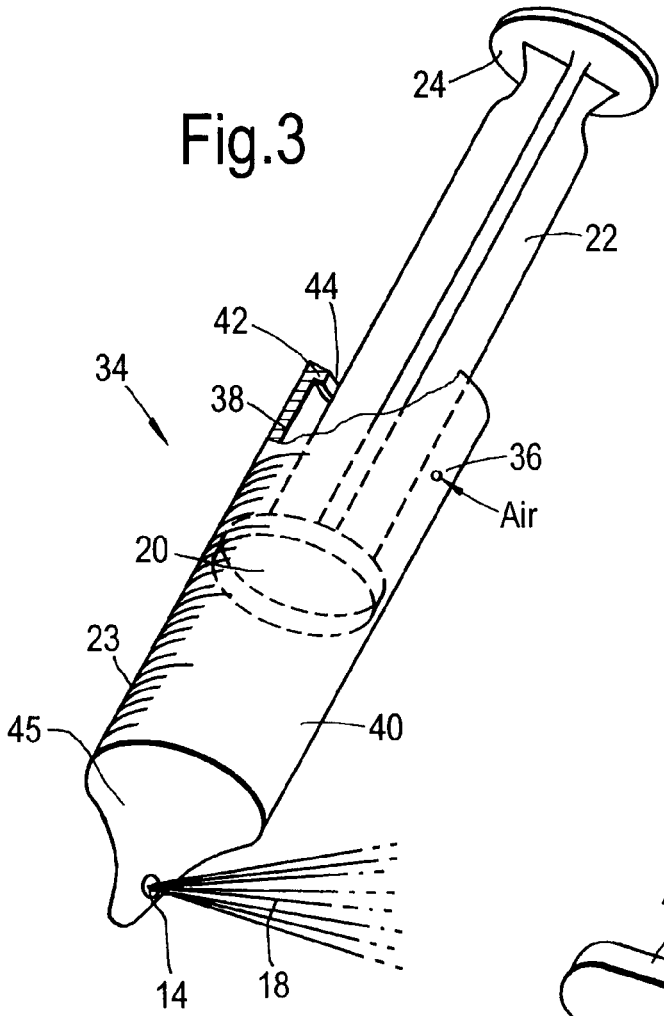
FIG. 3 is a perspective view partly fragmented of an embodiment intended to allow the patient to suck the medicine.

FIG. 3 illustrates a device 34 further provided with one or more air inlet opening(s) 36.

The opening(s) 36 is/are located at the upper portion 38 of the container cylinder 40 in an area where the opening 36 has no connection or influence upon the ordinary operations of suction and compression by the plunger 20 and does not affect the accuracy of the intended dosage. The opening 36 is of importance in the present embodiment which is suited to those applications where the administrator prefers that the medicine be dispensed from the container cylinder 40 by the patient sucking the device instead of the fluid being entered into his mouth under compression by pressure of the plunger 20.

The cylinder 40 has a formed distal end 45 which can be a nozzle as shown or of nipple shape (not shown) and requires only a minimal mouth opening and is most suited to young children.

In operation the plunger 20 is pulled upwards to a stopping point 42 where the plunger 20 is detent stopped close to the upper lip 44 of the container cylinder 40. At this plunger position the opening(s) 36 is/are exposed to the entry of air, which allows the patient to suck the medicine at his own pace.

Where multiple air openings 36 appear in the container cylinder 40 the diameter of each air opening 36 can be very small, thus preventing any inadvertent spillage of liquid through said openings.

Figure 4:
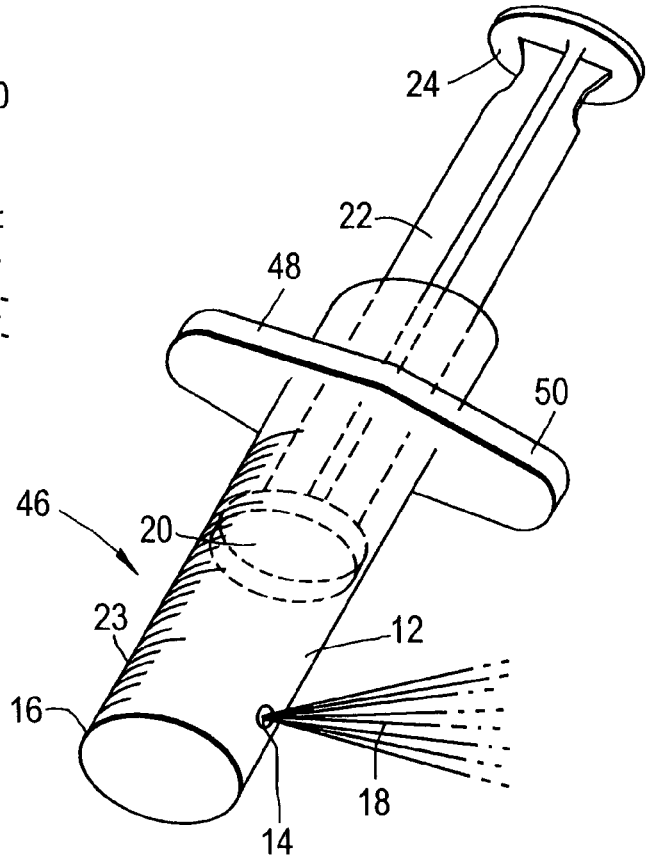
FIG. 4 is a perspective view of an embodiment provided with finger grip flanges.

Seen in FIG. 4 is an embodiment of the medicine dispenser device 46 for liquids to be swallowed. The device comprises an elongated cylinder 12 serving as a container for the liquid medicine. The device 46 is provided with a dispensing outlet 14 proximate to the distal end 16 of the cylinder.

The cylinder 12 is provided with opposed gripping flanges 48, 50 positioned at a distance of at least 5 mm, preferably at a distance of between 5 mm and 50 mm from the proximal end of the cylinder. This novel position has been found to enable the user to establish a firm controlled grip of the device 46.

Figure 5:
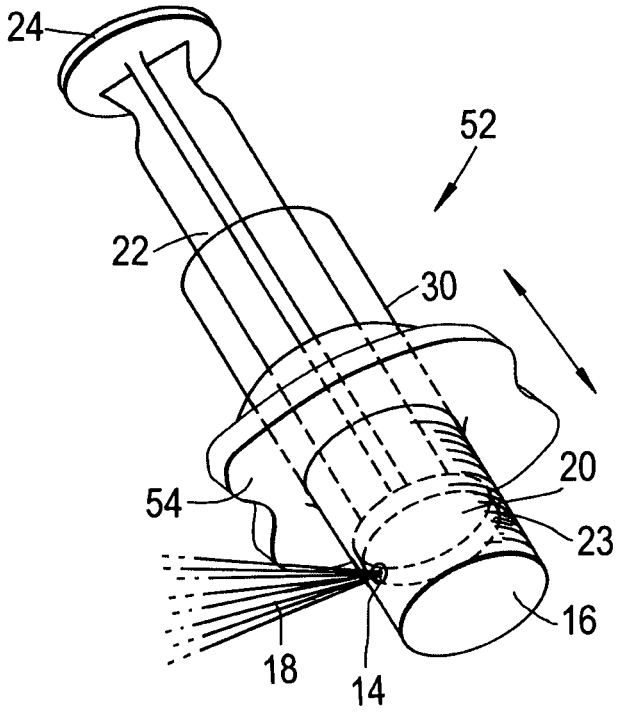
FIG. 5 is a perspective view of an embodiment carrying an adjustable position spacing disk to control depth of entry.

Referring now to FIG. 5, there is depicted a further medicine dispenser device 52 particularly useful when treating children and patients who are not fully cooperative.

In the present embodiment the device 52 is similar to that seen FIG. 2, wherein the device comprises an elongated cylindrical container 30 holding the liquid medicine. The device 52 is provided, in accordance with the requirements of its use and the type of liquid to be dispensed, with at least one dispensing outlet 14 proximate to the distal end 16 of the container cylinder 30.

An adjustable position lip contact disk 54 is mounted on the cylindrical container 30. The disk 54, is slidably adjustable and can be moved to take up any position between 5-55 mm from the distal end of the container. Such adjustment allows a single embodiment to serve for different size oral cavities of different patients.

Figure 6:
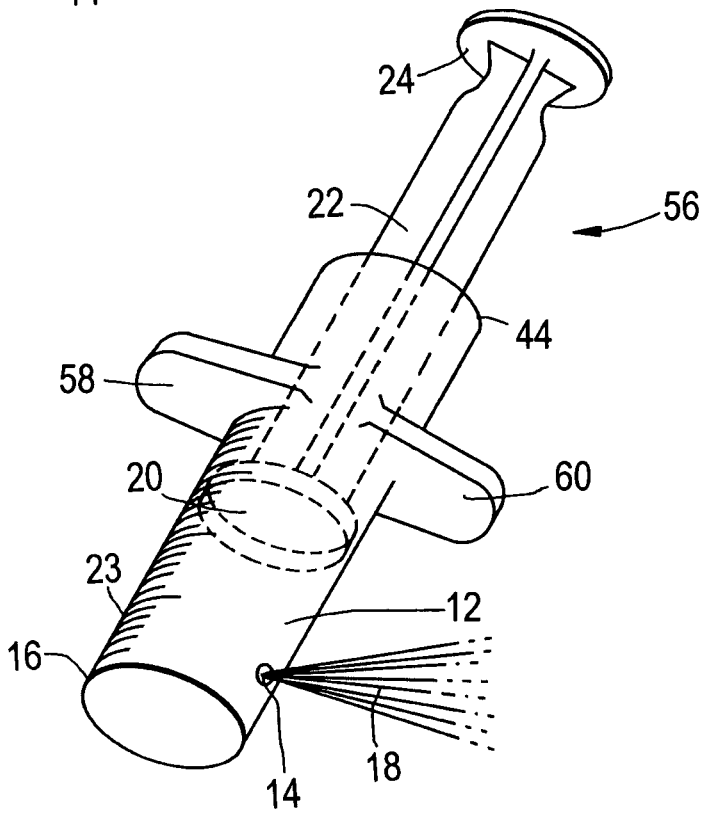
FIG. 6 is a perspective view of an embodiment provided with finger grip flanges substantially spaced from the proximate end of the cylinder.

FIG. 6 shows a medicine dispenser device 56 for liquids intended to be swallowed, which is similar to the device 46 seen in FIG. 4.

The cylinder 12 is provided with opposed gripping flanges 58, 60 which are positioned at a distance of between 5 mm and 50 mm from the proximal end 44 thereof.

This repositioning of the gripping flanges at a distance removed from the proximal end 44, where they are usually placed, has been found to enable the user to establish a firm controlled grip of the device 56 and is particularly helpful to provide the user with a firm and steady grip, without wobble.

Figure 7:
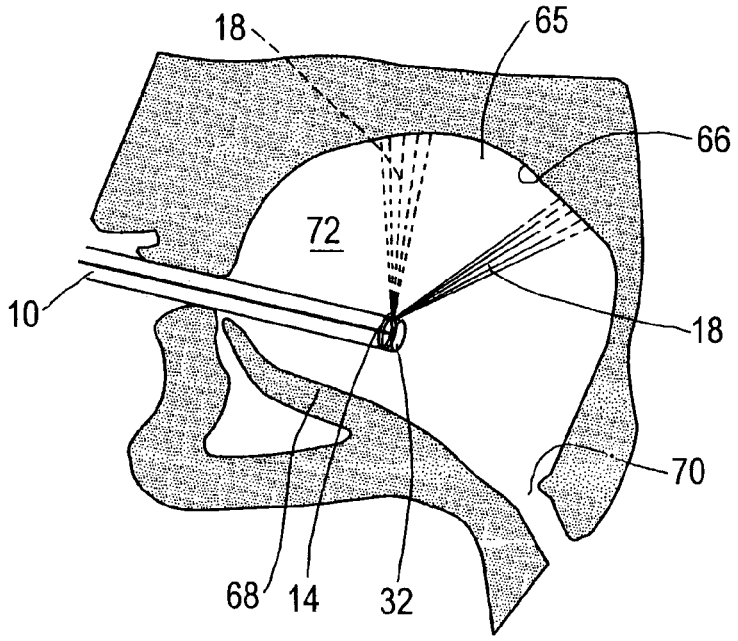
FIG. 7 is a diagrammatic view of a twin-jet medicine dispenser device in use showing the oral cavity of the patient.

Referring now to FIG. 7, there is depicted for reference purposes the oral cavity 72 of a patient showing a medicine dispenser device 62 in operation.

The distal end 32 of the device 62 is seen occupying part of the space in the oral cavity 72. As the device 62 has two discharge apertures of the same type as the single aperture 14 in FIG. 1, said apertures dispense two streams 18 of dispensed liquid directed to impact the enveloping surfaces 65, 66, and 68 of the cavity.

The liquid streams 18 are seen as impacting surfaces of the palette, well removed from the patient's windpipe and throat opening 70.

The enveloping surfaces seen in the diagram comprise the palette 65, the inner cheek 66 and the tongue 68 of the patient.

Figure 8:
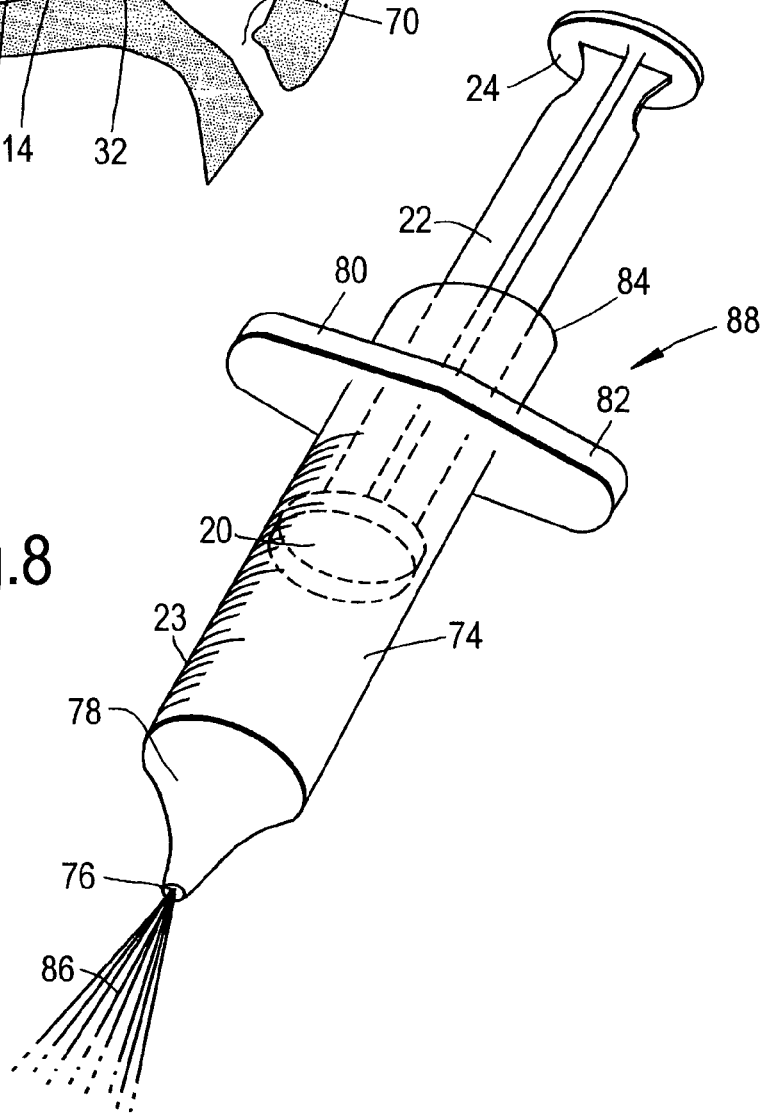
FIG. 8 is a perspective view of an embodiment provided with finger grip flanges substantially spaced from the proximate end of the cylinder.

Referring now to FIG. 8 there is seen a standard medicine syringe device 88 for liquids.

The device 88 comprises an elongated container cylinder 74 serving as a container for the liquid medicine. The device 72 is provided, in accordance with the requirements of its use and the type of liquid to be dispensed, with at least one dispensing outlet 76 at the distal end 78 of the cylinder 74.

A piston-like member 20 is sized for close frictional sliding engagement with the inner surface of the cylinder 74. The member 20, together with the stem 22 and end plate 24 provides the means for drawing liquids into the cylinder 74 and afterwards expelling the liquids therefrom through the outlet 76 to the patient.

The cylinder 74 is provided with opposed gripping flanges 8, 82 positioned at a distance of at least 5 mm from the proximal end 84 of the cylinder 74. The preferred position of the opposed gripping flanges is a distance of between 5 mm and 50 mm from the proximal end 84 of the cylinder 74.

The flanges 80, 82 are useful in providing a good grip of the device 88 during use.

Figure 9:
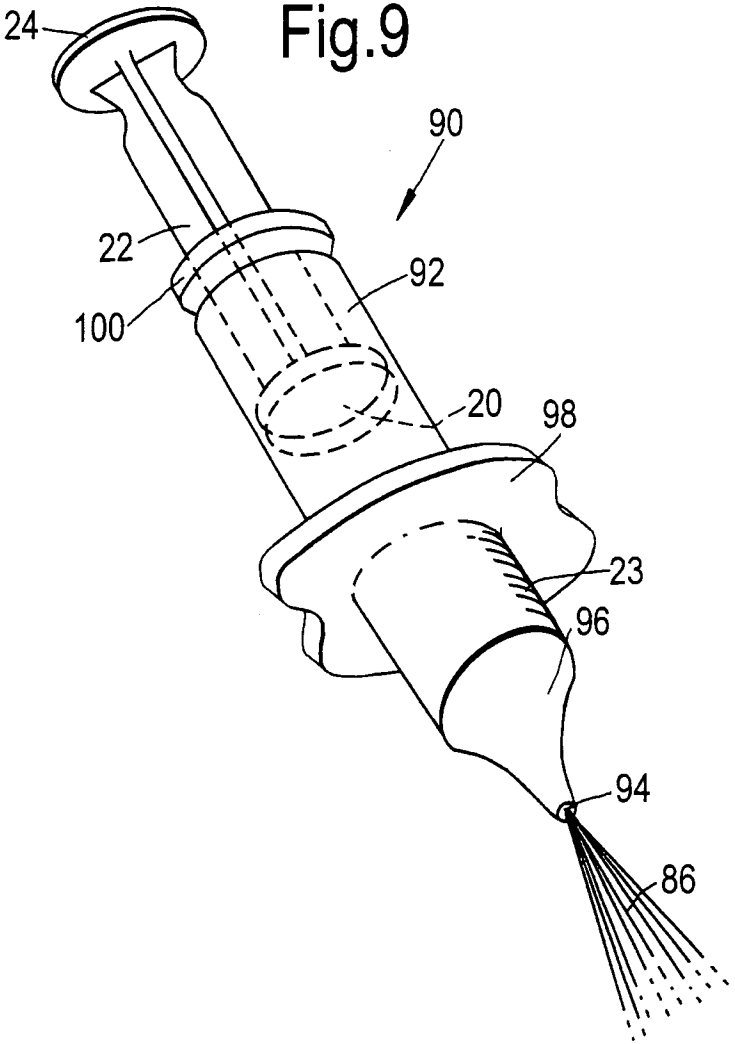
FIG. 9 is a diagrammatic view of an embodiment provided with a lip abutment disk.

Turning now to FIG. 9 there is seen a further standard medicine dispenser device 90 for liquids intended to be swallowed, the device 90 being particularly useful for children and patients who find it difficult to cooperate.

The device comprises an elongated cylinder 92 serving as a container for the liquid medicine. The device is provided, in accordance with the requirements of its use and the type of liquid to be dispensed, with a dispensing outlet 94 at the distal end 96 of the cylinder 92. A fingergrip 100 is seen at the proximate end of the cylinder 92.

The device 92 further comprises a disk 98 mounted on the cylinder 92, at a distance of between 5-55 mm from the distal end 96 of the container. The disk is sized and positioned to abut the patient's lips upon insertion of the device into the mouth of the patient and to delineate the extent of insertion of the distal end 96 into the patient's mouth.

Figure 10:
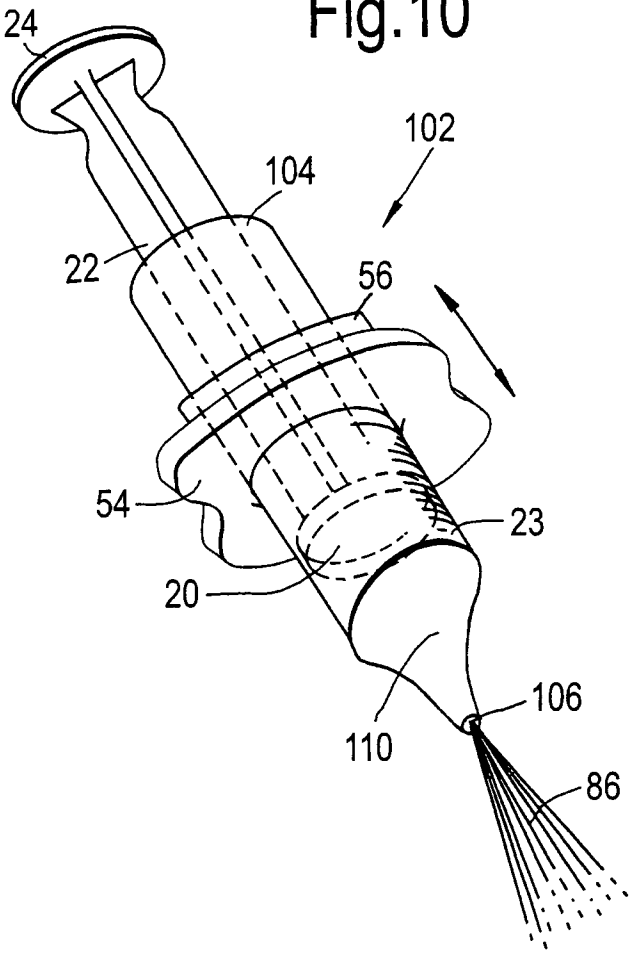
FIG. 10 is the same as FIG. 9 except that the disk position is adjustable.

FIG. 10 illustrates a further standard medicine dispenser device 102 for liquids intended to be swallowed. Also the present embodiment is particularly useful for children and patients who find it difficult to cooperate.

The device 102 comprises an elongated cylinder serving as a container for the liquid medicine, the device 102 being provided, in accordance with the requirements of its use and the type of liquid to be dispensed, with a dispensing outlet 106 at the distal end of the cylinder and the device further comprising an adjustable slidable disk 54 mounted on the elongated cylindrical container, sized and positionable to engage the patient's lips upon insertion of the device into the mouth of the patient and to delineate the extent of insertion of the distal end 110 of the cylinder 104.

A piston-like member 20 is sized for close frictional sliding engagement with the inner surface of the cylinder 104. The member 20, together with the stem 22 and end plate 24 provides the means for drawing liquids into the cylinder 104 and afterwards expelling the liquid 86 therefrom through the outlet 106 to the patient.

Optionally the disk 54 is provided with a short guide cylinder 56. The disk 54 can be moved to take up any position between 5-55 mm from the distal end 110 of the cylinder 104. Such adjustment allows a single embodiment to serve for different size oral cavities of different patients.

Figure 11:
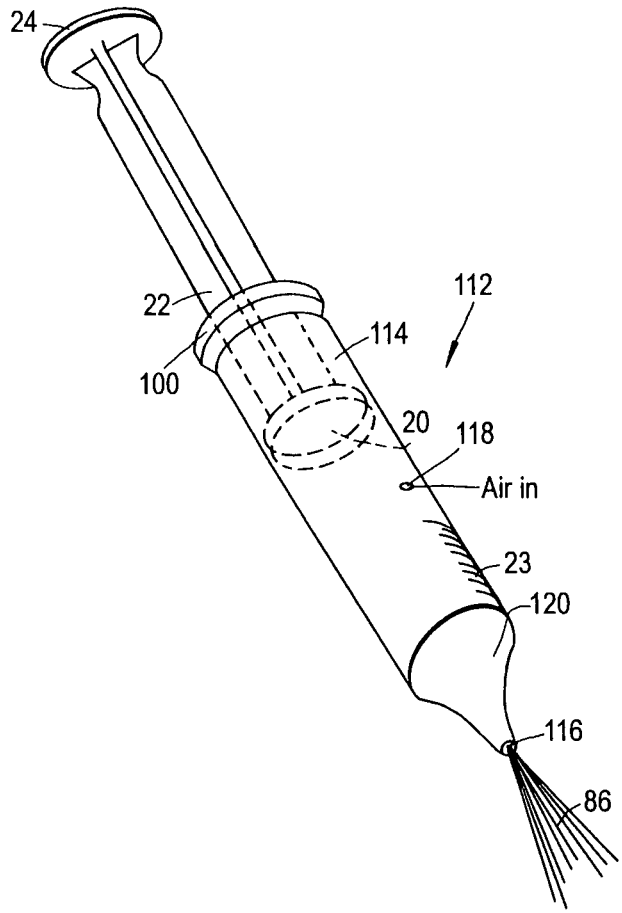
FIG. 11 is a perspective view of an embodiment arranged to optionally allow the patient to suck the medicine.

With reference now to FIG. 11, there is seen an embodiment of a standard medicine dispenser device 112 for liquids intended to be swallowed, particularly for children and patients who find it difficult to cooperate.

The device comprises an elongated container cylinder 114 for liquid medicine.

The device is provided, in accordance with the requirements of its use and the type of liquid to be dispensed, with a dispensing outlet 116 at the distal end 118 of the cylinder 114.

A piston-like member 20 is sized for close frictional sliding engagement with the inner surface of the cylinder 114. The member 20, together with the stem 22 and end plate 24 provides the means for drawing liquids into the cylinder 114 and afterwards and in some modes of use expelling the liquid 86 therefrom through the outlet 116 to the patient. However the present embodiment offers an alternative method of dispensing the medicine.

According to this aspect of the present invention, an air entry opening 118 is provided in a side surface of the cylinder 114 above the level of the liquid medicine when the container is filled with the maximum recommended dosage of liquid to be dispensed.

In operation the plunger 20 is pulled upwards to draw in the liquid medicine, and then further drawn towards finger grip 100 above the position wherein said container is filled with the maximum recommended dosage of liquid to be dispensed from said container. At this plunger position opening(s) 118 is/are exposed to the entry of air, into the cylinder which allows the patient to suck the medicine from the distal end 120 at his own pace through nozzle 116 or through a nipple-like end (not shown).

Where multiple air openings 118 appear in the cylinder 114 the diameter of each air opening 118 can be very small, thus preventing any inadvertent spillage of liquid therethrough.

It will be evident to those skilled in the art that the invention is not limited to the details of the foregoing illustrative embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A medicine dispenser device for liquids intended to be swallowed, particularly by children and patients who find it difficult to cooperate, the device comprising an elongated cylinder serving as a container for said liquid, said device being provided, in accordance with the requirements of its use and the type of liquid to be dispensed, with at least one dispensing exit outlet at the distal end of said cylinder, said cylinder having a longitudinal axis and said at least one dispensing outlet being positioned to direct at least one stream of dispensed liquid at an angle of between 20° and 170° relative to the distal end of the longitudinal axis of said container, the safety arrangement of the device being such that upon introduction of the distal end of said device into the mouth of a patient, the at least one stream of dispensed liquid is directed to exit towards at least one enveloping surface of the mouth cavity and not in a direction toward the patient's windpipe and the throat opening wherein said device further comprises a disk adjustably, slidably mounted on said elongated cylindrical container, to be positioned at a distance of between 5-55 mm from the distal end of said container, and sized and positionable to engage the patient's lips upon insertion of the distal end of said device into the mouth of the patient and to delineate the extent of insertion of said distal end of said device into the patient's mouth.

2. The medicine dispenser device according to claim 1, wherein said at least one enveloping surface is selected from the group consisting of an area of the inner cheek, the tongue and combinations thereof.

3. The medicine dispenser device according to claim 1, further comprising a piston-like member sized for close frictional engagement with the inner surface of said cylinder for drawing liquids into the cylindrical container and afterwards expelling the liquids from said container through said at least one outlet.

4. The medicine dispenser device for medicine for liquids according to claim 1, comprising one dispensing exit outlet for administering liquid, wherein said cylinder has a longitudinal axis and said dispensing exit outlet is located in a manner directing the stream of dispensed liquid at an angle of between 20° and 170° relative to the distal end of the longitudinal axis of said container.

5. The medicine dispenser device according to claim 1, comprising at least two spaced-apart exit outlets for dispensing liquids, located at the distal end of said cylinder, said device being designed to be inserted into the patient's mouth and to enable directing the streams of the dispensed liquid towards at least two enveloping surfaces of the patient's mouth cavity, each of said streams being dispensed at an angle of between 20° and 170° relative to the distal end of the longitudinal axis of said container.

6. The medicine dispenser device according to claim 3 wherein said elongated cylinder is further provided with at least one air entry hole provided in a side surface of said cylinder adjacent the proximal end thereof above the position of said piston-like member when said container is filled with the maximum recommended dosage of liquid to be dispensed from said container.

7. The medicine dispenser device according to claim 1, wherein said cylinder is provided with opposed gripping flanges positioned at a distance of at least 5 mm from the proximal end of said cylinder.

8. The medicine dispenser device according to claim 1, wherein said cylinder is provided with opposed gripping flanges positioned at a distance of between 5 mm and 50 mm from the proximal end of said cylinder.

9. The medicine dispenser device according to claim 1 further comprising a piston-like member sized for close frictional engagement with the inner surface of said cylinder for drawing liquids into the cylindrical container and afterwards expelling the liquids from said container through said at least one outlet and wherein said elongated cylinder is further provided with at least one air entry hole provided in a side surface of said cylinder adjacent the proximal end thereof above the position of said piston-like member when said container is filled with the maximum recommended dosage of liquid to be dispensed from said container.

* * * * *